US009889623B2

(12) United States Patent
Frayne et al.

(10) Patent No.: US 9,889,623 B2
(45) **Date of Patent: *Feb. 13, 2018**

(54) AUTOMATED INFLATION DEVICE

(71) Applicant: Sealed Air Corporation (US), Charlotte, NC (US)

(72) Inventors: Shawn Michael Frayne, Tampa, FL (US); Paul Chudy, New York, NY (US); Tung Yiu Fok, Hong Kong (CN)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/138,019

(22) Filed: Apr. 25, 2016

(65) Prior Publication Data

US 2016/0236437 A1 Aug. 18, 2016

Related U.S. Application Data

(63) Continuation of application No. 13/926,845, filed on Jun. 25, 2013, now Pat. No. 9,321,236.

(51) Int. Cl.
*B31D 5/00* (2017.01)
*B65D 81/05* (2006.01)

(52) U.S. Cl.
CPC ..... *B31D 5/0073* (2013.01); *B65D 81/052* (2013.01); *B31D 2205/007* (2013.01);
(Continued)

(58) Field of Classification Search
CPC ..... B31D 5/0073; B31D 2205/007; B31D 2205/0082; B31D 2205/0088;
(Continued)

(56) References Cited

U.S. PATENT DOCUMENTS 2,799,314 A 7/1957 André et al.
3,207,420 A 9/1965 Navarrete-Kindelan
(Continued)

FOREIGN PATENT DOCUMENTS

DE 39 22 802 A1 1/1991
DE 40 07 128 A1 4/1991
(Continued)

OTHER PUBLICATIONS

Sealed Air Ultipack® Automated Void Containment System, *The Ultimate Solution for Automated Void Containment*, Distributed by Sealed Air Corporation (US), Elmwood Park, NJ, Oct. 2008.
(Continued)

*Primary Examiner* — Timothy L Maust
*Assistant Examiner* — Timothy P Kelly
(74) *Attorney, Agent, or Firm* — Alston & Bird LLP

(57) ABSTRACT

Various embodiments of the present invention generally relate to an automated inflation device configured for inflating an inflatable structure, which can then be used—for example—as a protective packaging material. As described in detail herein, various embodiments of the inflation device are configured to be mounted on a wall for convenient installation and use. According to certain embodiments, the inflation device is configured to automatically inflate multiple inflatable chambers in the inflatable structure using an efficient inflation-at-a-distance method. Moreover, various embodiments are provided with one or more user input controls and/or remote sensors to enable a user to conveniently request inflation of a particular number of inflatable chambers or a particular length of the inflatable structure.

16 Claims, 8 Drawing Sheets

(52) U.S. Cl.
CPC ..... *B31D 2205/0082* (2013.01); *B31D 2205/0088* (2013.01)

(58) Field of Classification Search
CPC . B31D 2205/0023; B65D 81/052; F17C 7/00; F17C 2250/034; F17C 2250/0478
USPC ..... 141/94, 114, 197, 313–317; 53/403, 67, 53/79, 496, 500; 206/522
See application file for complete search history.

(56) References Cited

U.S. PATENT DOCUMENTS

| | | | | |
|---|---|---|---|---|
| 3,337,117 | A | 8/1967 | Lehmacher et al. | |
| 4,465,188 | A | 8/1984 | Soroka et al. | |
| 4,557,377 | A | 12/1985 | Maloney | |
| 4,949,530 | A | 8/1990 | Pharo | |
| 5,144,708 | A | 9/1992 | Pekar | |
| 5,263,587 | A | 11/1993 | Elkin et al. | |
| 5,308,163 | A | 5/1994 | Abe | |
| 5,348,157 | A | 9/1994 | Pozzo | |
| 5,351,828 | A | 10/1994 | Becker et al. | |
| 5,427,830 | A | 6/1995 | Pharo | |
| 5,454,642 | A | 10/1995 | De Luca | |
| 5,469,966 | A | 11/1995 | Boyer | |
| 5,515,975 | A | 5/1996 | Jarvis et al. | |
| 5,527,012 | A | 6/1996 | Vinkel et al. | |
| 5,581,983 | A | 12/1996 | Murakami | |
| 5,693,163 | A | 12/1997 | Hoover et al. | |
| 5,803,263 | A | 9/1998 | Pozzo | |
| 5,829,492 | A | 11/1998 | Gavronsky et al. | |
| 5,830,780 | A | 11/1998 | Dennison et al. | |
| 5,942,076 | A | 8/1999 | Salerno et al. | |
| 6,015,047 | A | 1/2000 | Greenland | |
| 6,276,532 | B1 | 8/2001 | Sperry et al. | |
| 6,311,740 | B1 | 11/2001 | Sperry et al. | |
| 6,569,283 | B1 | 5/2003 | Sperry et al. | |
| 6,913,803 | B2 | 7/2005 | Peper | |
| 6,978,893 | B2 | 12/2005 | Peper | |
| 7,165,677 | B2 | 1/2007 | Tanaka et al. | |
| 7,168,566 | B2 | 1/2007 | Anderson et al. | |
| 7,168,567 | B2 | 1/2007 | Peper et al. | |
| 7,201,273 | B2 | 4/2007 | Chen et al. | |
| 7,228,969 | B2 | 6/2007 | Nakano | |
| 7,273,142 | B2 * | 9/2007 | Huis | B31D 5/0073 198/369.2 |
| 7,297,387 | B2 | 11/2007 | Koyanagi | |
| 7,681,734 | B2 | 3/2010 | Liao et al. | |
| 7,828,146 | B2 | 11/2010 | Frayne | |
| 8,272,510 | B2 | 9/2012 | Frayne et al. | |
| 8,745,960 | B2 | 6/2014 | Kannankeril et al. | |
| 9,321,236 | B2 * | 4/2016 | Frayne | B65D 81/052 |
| 2002/0108351 | A1 | 8/2002 | Sperry et al. | |
| 2002/0153468 | A1 | 10/2002 | Folkmar | |
| 2002/0166788 | A1 | 11/2002 | Sperry et al. | |
| 2003/0108699 | A1 | 6/2003 | Tanaka | |
| 2003/0109369 | A1 | 6/2003 | Lerner et al. | |
| 2003/0139271 | A1 | 7/2003 | Vangedal-Nielsen et al. | |
| 2004/0022459 | A1 | 2/2004 | Thomasset | |
| 2004/0211697 | A1 | 10/2004 | Nakano | |
| 2005/0109411 | A1 | 5/2005 | Koyanagi | |
| 2005/0139508 | A1 | 6/2005 | Su | |
| 2005/0189257 | A1 | 9/2005 | Chen et al. | |
| 2005/0236295 | A1 | 10/2005 | Perkins et al. | |
| 2006/0090421 | A1 | 5/2006 | Sperry et al. | |
| 2006/0191817 | A1 | 8/2006 | Nishi et al. | |
| 2006/0201960 | A1 | 9/2006 | Frayne | |
| 2006/0289108 | A1 * | 12/2006 | McNamara, Jr. | B31D 5/0073 156/147 |
| 2007/0056647 | A1 | 3/2007 | Frayne | |
| 2007/0065047 | A1 | 3/2007 | Kojima et al. | |
| 2007/0084745 | A1 | 4/2007 | Yoshifusa | |
| 2007/0090013 | A1 | 4/2007 | Yoshifusa et al. | |
| 2007/0131575 | A1 | 6/2007 | Abe | |
| 2007/0163916 | A1 | 7/2007 | Yoshifusa | |
| 2007/0170084 | A1 | 7/2007 | Chen et al. | |
| 2007/0295633 | A1 | 12/2007 | Liao et al. | |
| 2008/0073238 | A1 | 3/2008 | Liao et al. | |
| 2008/0280744 | A1 | 11/2008 | Tanaka et al. | |
| 2009/0297068 | A1 | 12/2009 | Liao et al. | |
| 2010/0096290 | A1 | 4/2010 | Frayne | |
| 2010/0101970 | A1 | 4/2010 | Frayne | |
| 2011/0247725 | A1 | 10/2011 | Frayne et al. | |

FOREIGN PATENT DOCUMENTS

| | | |
|---|---|---|
| DE | 296 12 426 U1 | 10/1996 |
| EP | 0255780 A2 | 2/1988 |
| EP | 2070838 A1 | 6/2009 |
| FR | 2711115 A1 | 4/1995 |
| GB | 826784 | 1/1960 |
| JP | 4-154571 A | 5/1992 |
| WO | WO 2011/002190 A2 | 1/2011 |

OTHER PUBLICATIONS

Free-Flow Packaging International, "MINI PAK'R® Air Cushion Machine, User Manual Revision 4.1," Copyright © 2007-2012, USA.

International Searching Authority, International Search Report and Written Opinion for International Application No. PCT/US2014/042466, dated Sep. 4, 2014, 11 pages, European Patent Office, The Netherlands.

European Patent Office, Extended European Search Report for Application No. 13191652.0, dated Dec. 11, 2013, 7 pages, Germany.

United States Patent and Trademark Office, Office Action for U.S. Appl. No. 13/926,845, dated Jul. 30, 2015, 18 pages, U.S.A.

United States Patent and Trademark Office, Notice of Allowance for U.S. Appl. No. 13/926,845, dated Dec. 18, 2015, 18 pages, U.S.A.

* cited by examiner

AUTOMATED INFLATION DEVICE

CROSS-REFERENCE TO RELATED APPLICATIONS

This patent application is a continuation of U.S. patent application Ser. No. 13/926,845 filed Jun. 25, 2013, which is incorporated herein by reference in its entirety.

BACKGROUND OF THE INVENTION

Field of the Invention

Various embodiments of the present invention generally relate to automated inflation devices for use with inflatable structures and methods for using the same. In particular, various embodiments of the present invention are well suited for use in packaging applications.

Description of Related Art

Inflatable structures are an important part of the packaging industry. As an example, inflatable structures are commonly used as cushions to package items, either by wrapping the items in the inflatable structures and placing the wrapped items in a shipping carton, or by simply placing one or more inflatable structures inside of a shipping carton along with an item to be shipped. Used in this manner, the inflatable structures protect packaged items by absorbing impacts that might otherwise be fully transmitted to a particular item during transit, and also restrict movement of the packaged item within the carton to further reduce the likelihood of damage to the item.

Inflatable packaging has an advantage over non-inflatable packaging in that inflatable packaging can require less raw material to manufacture. Further, it is known within the art to make inflatable packaging such that it is inflatable on demand. Inflate-on-demand packaging allows the entity using the packaging materials to inflate the packaging materials only when needed, such as when packaging an item in a shipping container as described above. As a result, inflate-on-demand packaging materials can occupy less space in comparison to pre-inflated packaging materials, which makes inflate-on-demand packaging easier to store. Additionally, transportation of the packaging materials to the entity using them to package items can be less expensive than it would be if the packaging materials were already inflated because they can be shipped in significantly smaller containers.

However, there remains a need in the art for improved inflate-on-demand devices and methods. In particular, there is an on-going need for inflation devices that are efficient, have a low installation and operating cost, and are convenient and user-friendly to operate.

BRIEF SUMMARY OF THE INVENTION

Various embodiments of the present invention are directed to an inflation device for inflating an inflatable structure defining a plurality of inflatable chambers, the inflatable chambers being capable of holding therein a quantity of a fluid and having an external opening for receiving the fluid during inflation. According to various embodiments, the inflation device comprises a holder configured for holding the inflatable structure; an engagement device for engaging the inflatable structure and advancing the inflatable structure from the holder in a machine direction; a pressurized fluid source defining a fluid outlet, the pressurized fluid source configured for inflating at least one proximate inflatable chamber in the inflatable structure by directing pressurized fluid from the fluid outlet through the external opening of the at least one proximate inflatable chamber; a remote sensor configured for being removably secured to a substantially vertical surface beneath the engagement device and for sensing the presence of the inflatable structure in proximity to the remote sensor; and a control unit in communication with the remote sensor, the control unit being configured to cause the engagement device and pressurized fluid source to advance the inflatable structure in the machine direction and inflate multiple inflatable chambers of the inflatable structure until the remote sensor detects the presence of the inflatable structure in proximity to the remote sensor.

According to various other embodiments, the inflation device may comprise a holder configured for holding the inflatable structure; an engagement device for engaging the inflatable structure and advancing the inflatable structure in a machine direction; and a pressurized fluid source defining a fluid outlet, the pressurized fluid source configured for inflating at least one proximate inflatable chamber in the inflatable structure by directing pressurized fluid from the outlet through the external opening of the at least one proximate inflatable chamber. In such embodiments, the engagement device may be configured to advance the inflatable structure such that insertion does not occur between the pressurized fluid source outlet and the external valve opening during inflation.

According to various other embodiments, the inflation device may comprise a housing configured for being mounted on a substantially vertical surface; a holder configured for holding the inflatable structure in proximity to the housing; an engagement device operatively connected to the housing and configured for engaging the inflatable structure and advancing the inflatable structure in a machine direction; and a pressurized fluid source operatively connected to the housing and defining a fluid outlet, the pressurized fluid source configured for inflating at least one inflatable chamber in the inflatable structure by directing pressurized fluid from the outlet through the external opening of the at least one inflatable chamber.

BRIEF DESCRIPTION OF THE SEVERAL VIEWS OF THE DRAWINGS

Figure 1:
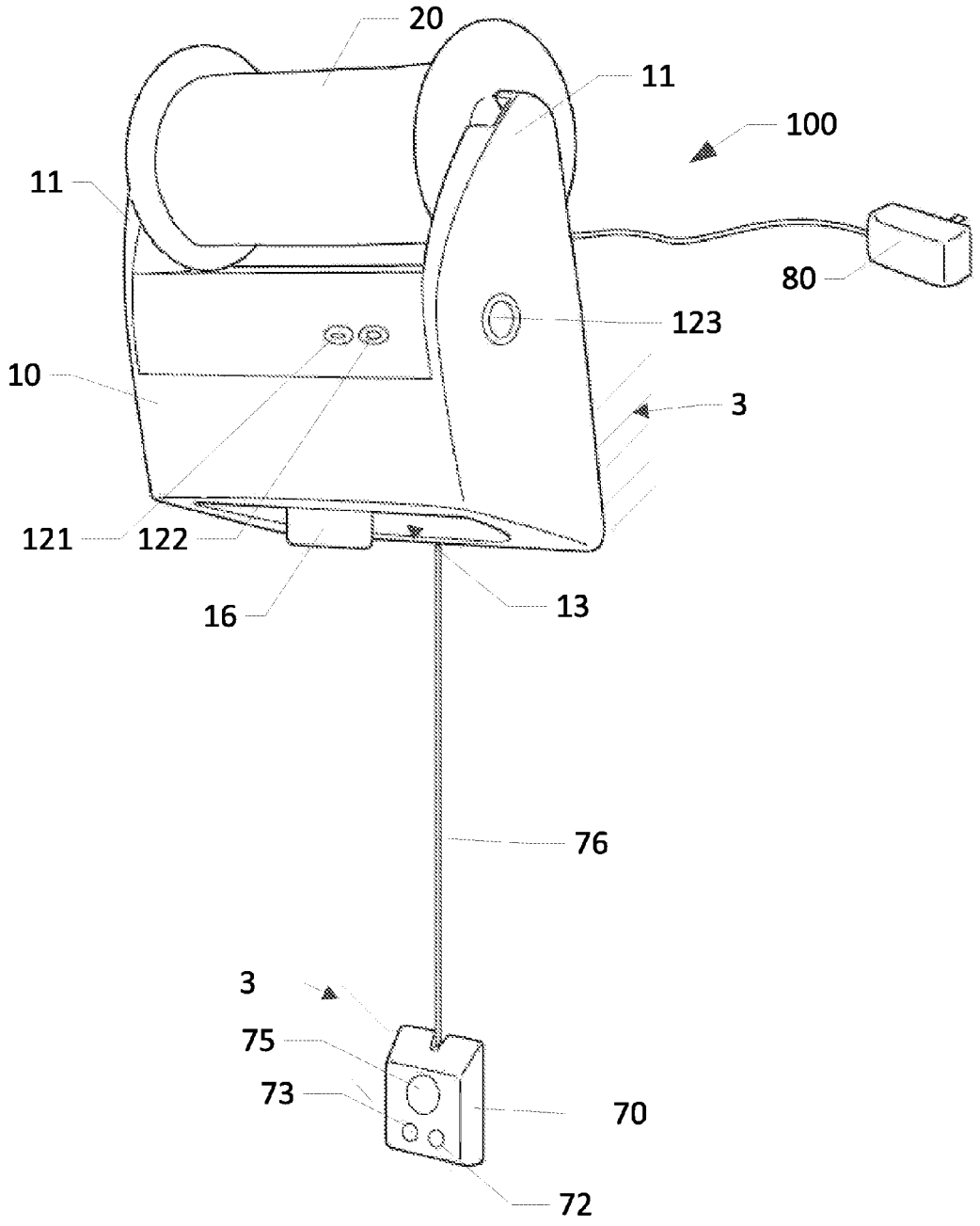
Figure 2A:
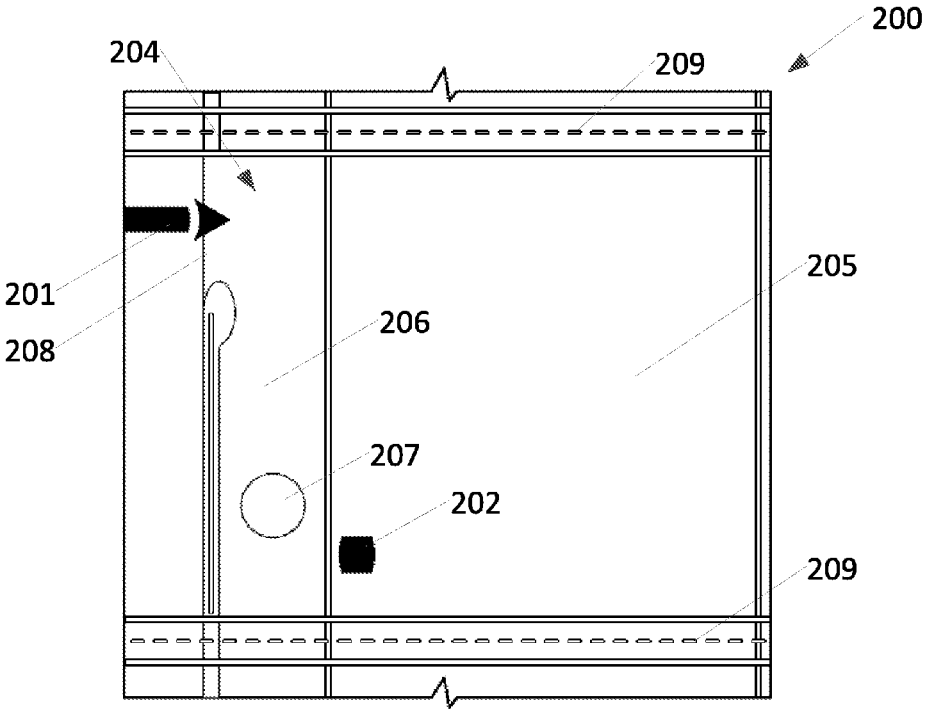
Figure 2B:
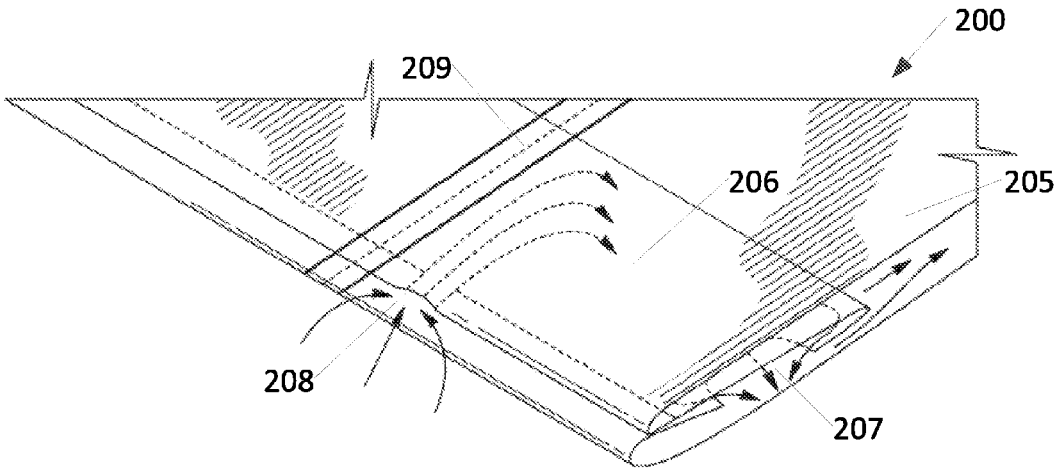
Figure 3:
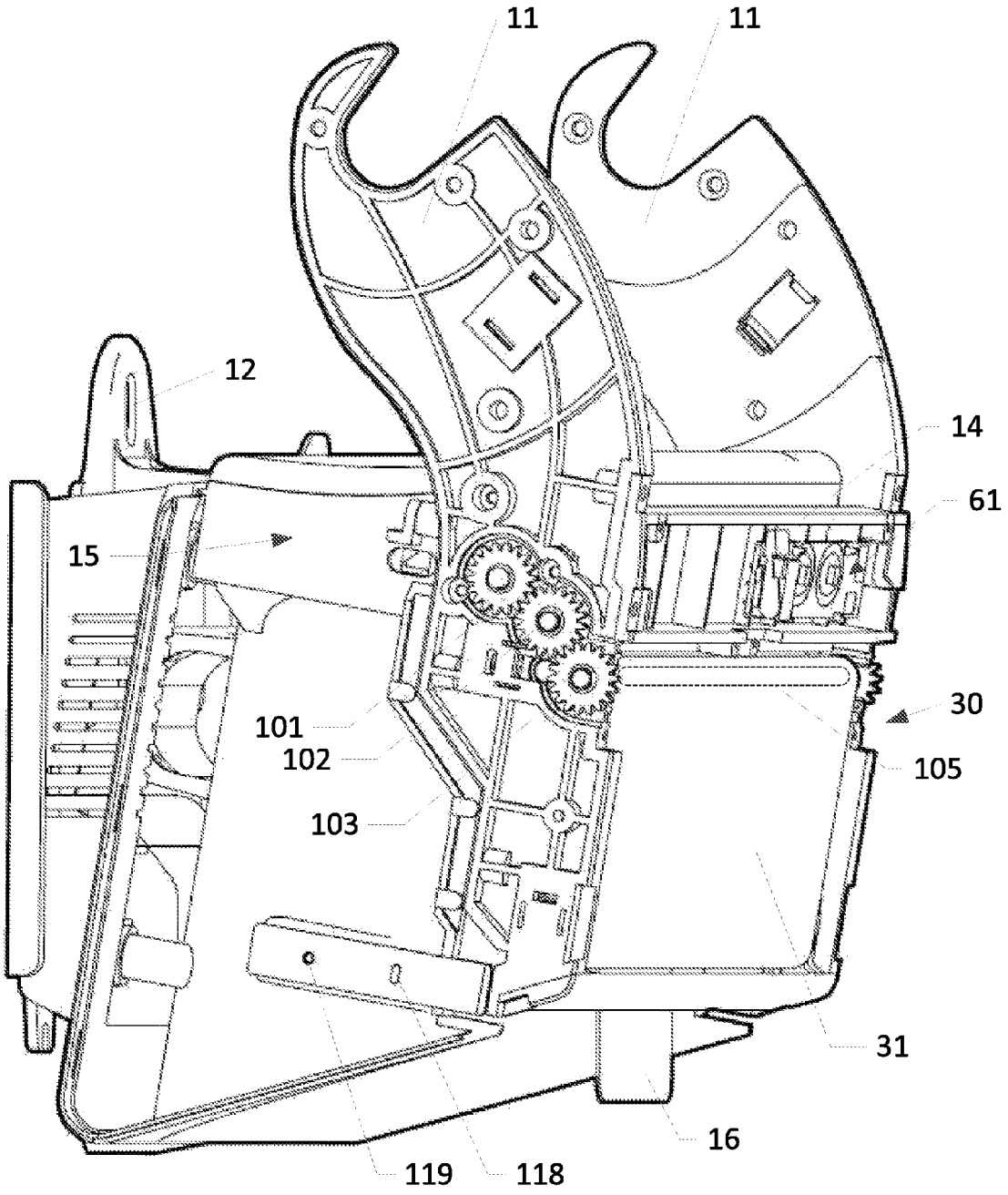
Figure 4:
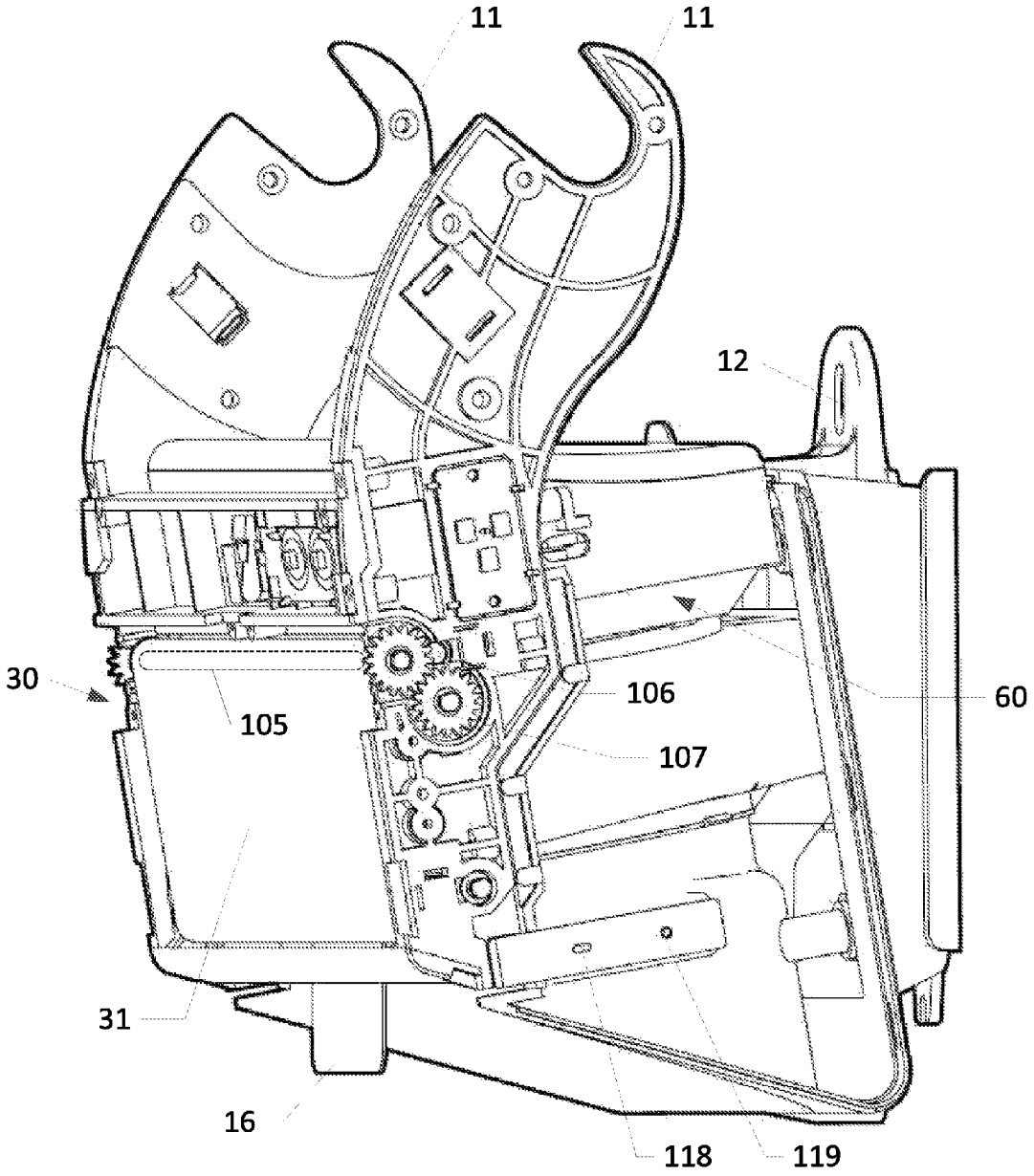
Figure 5:
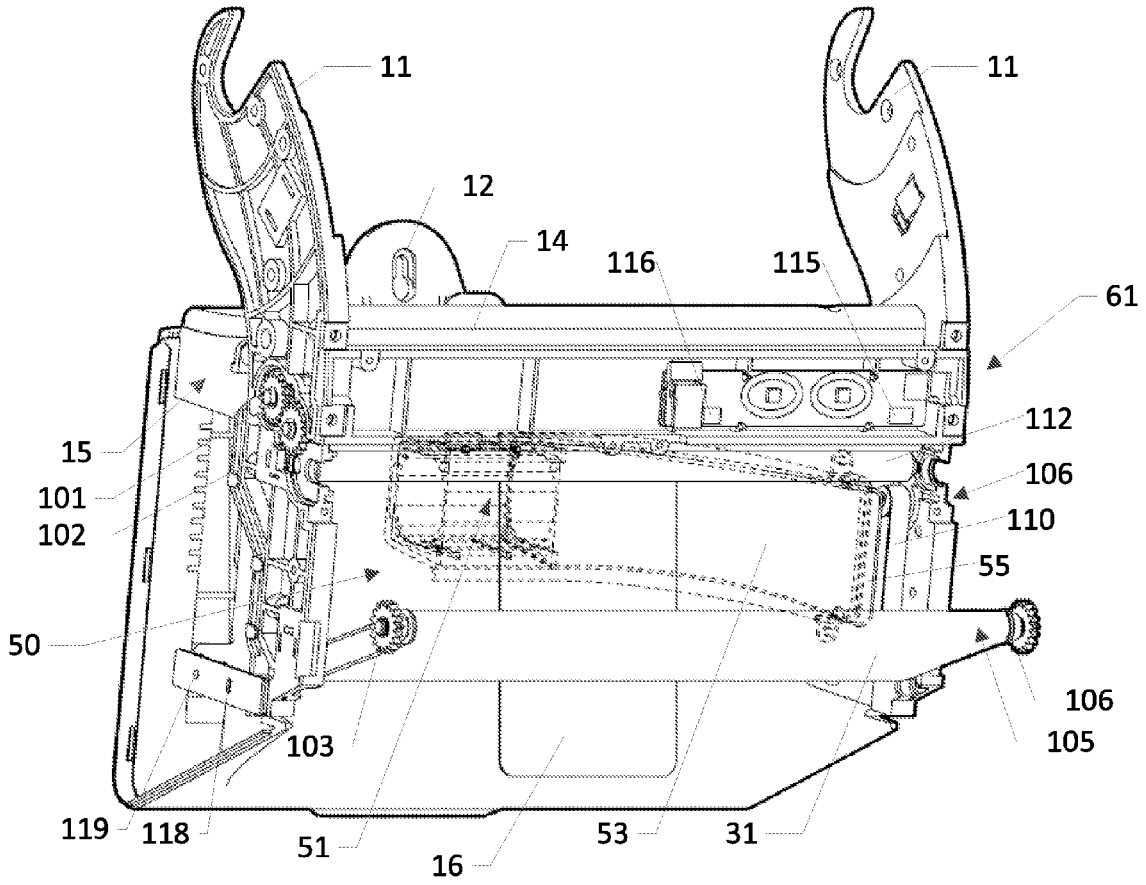
Figure 6:
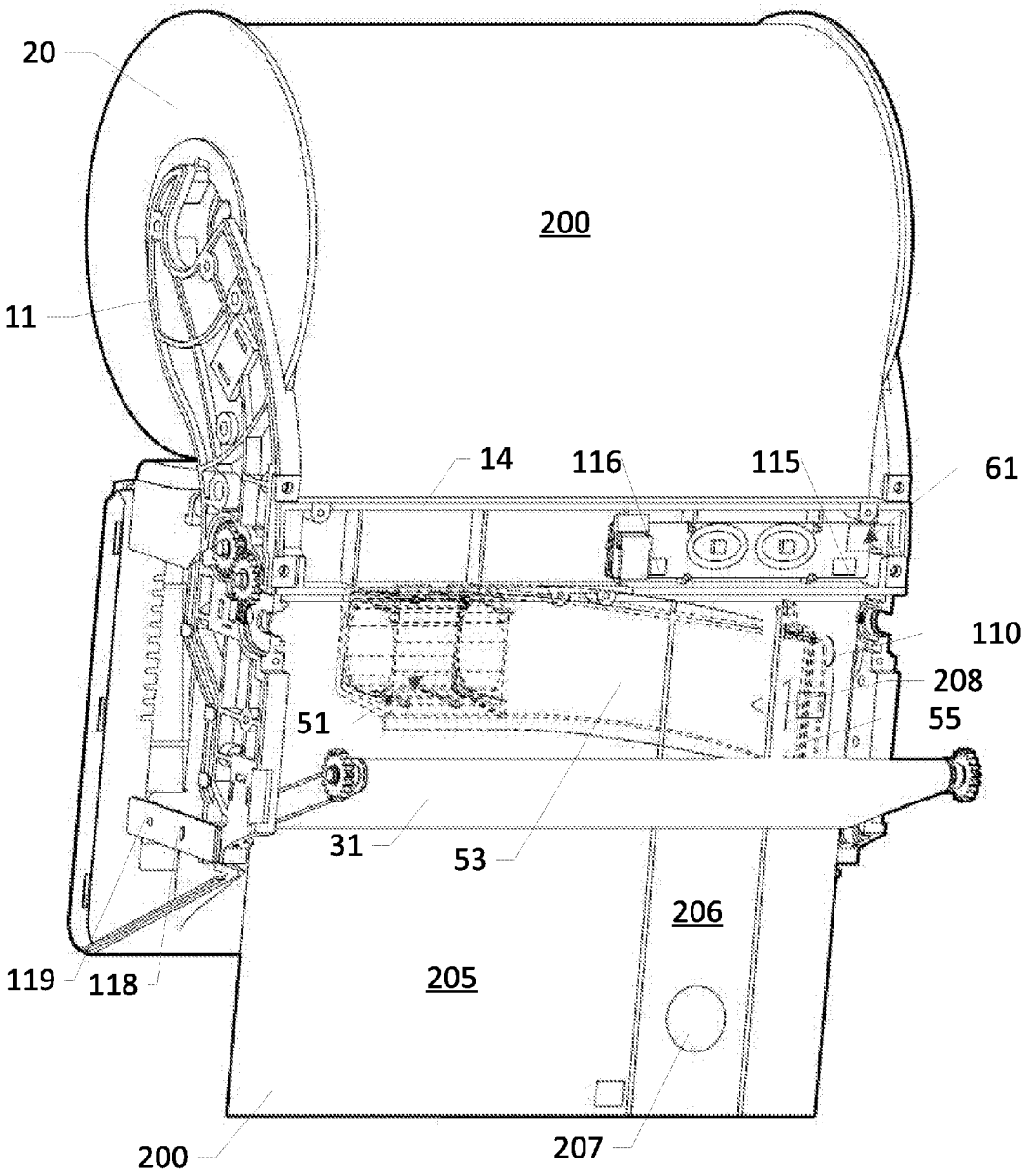
Figure 7:
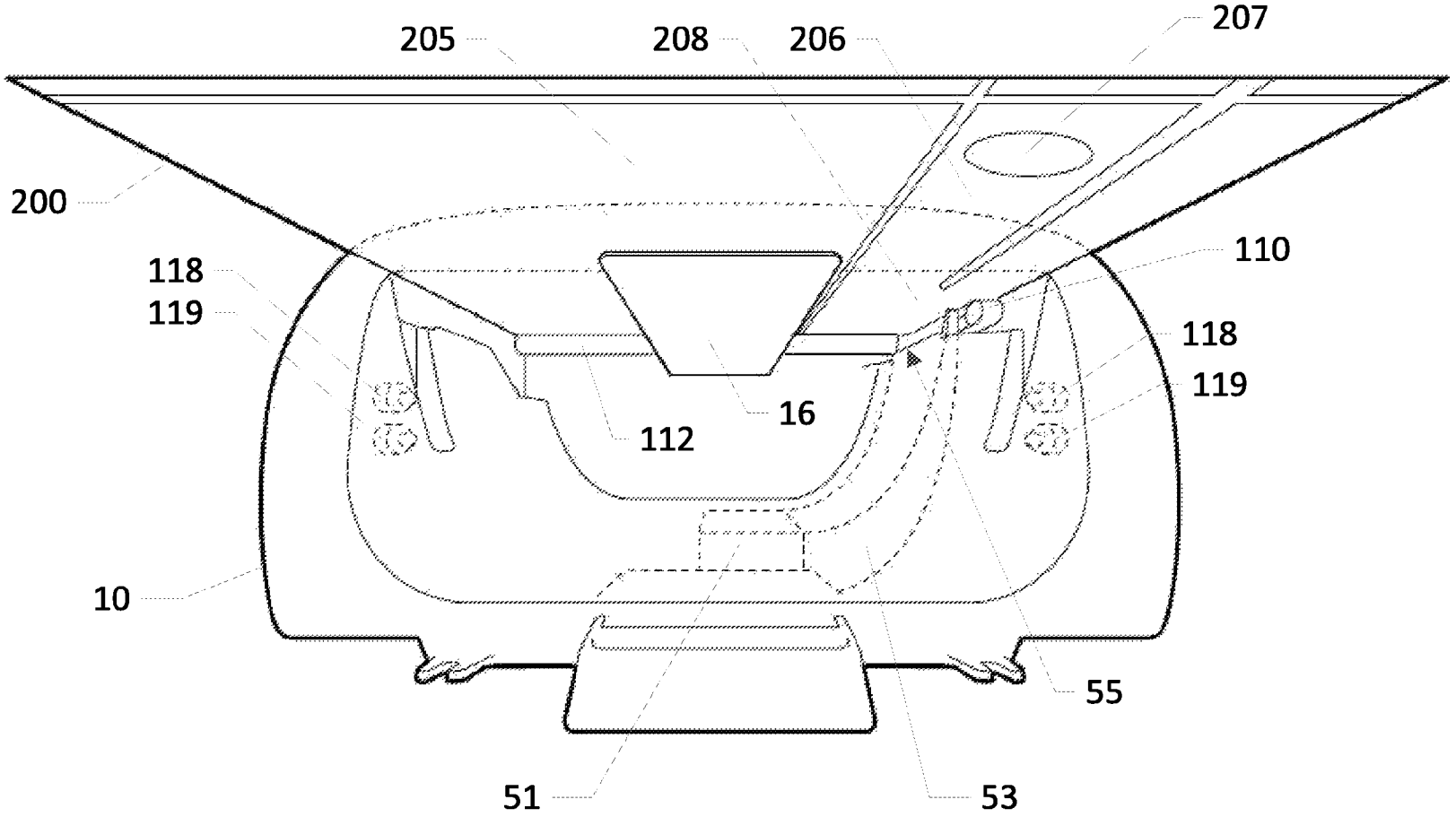
Figure 8C:
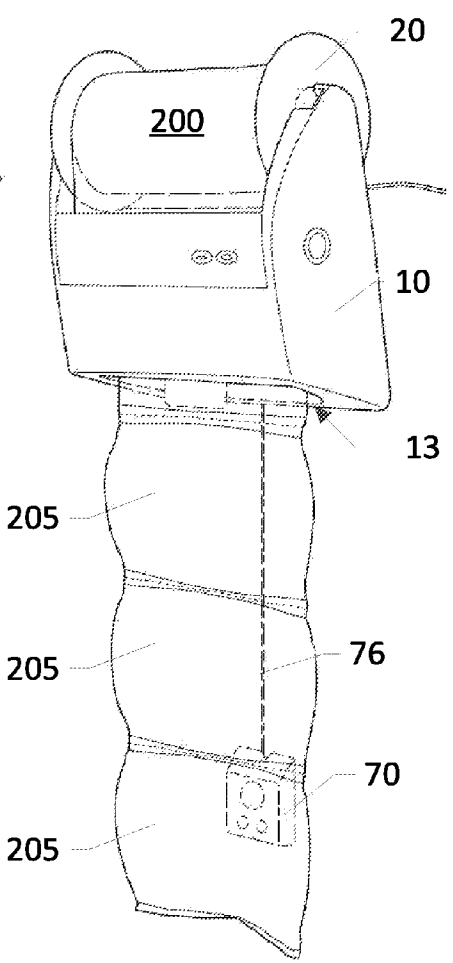
Figure 8B:
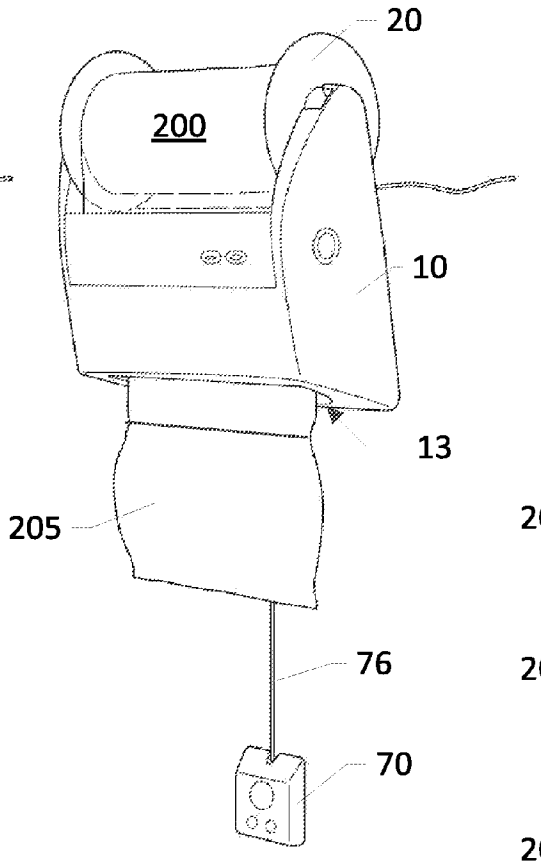
Figure 8A:
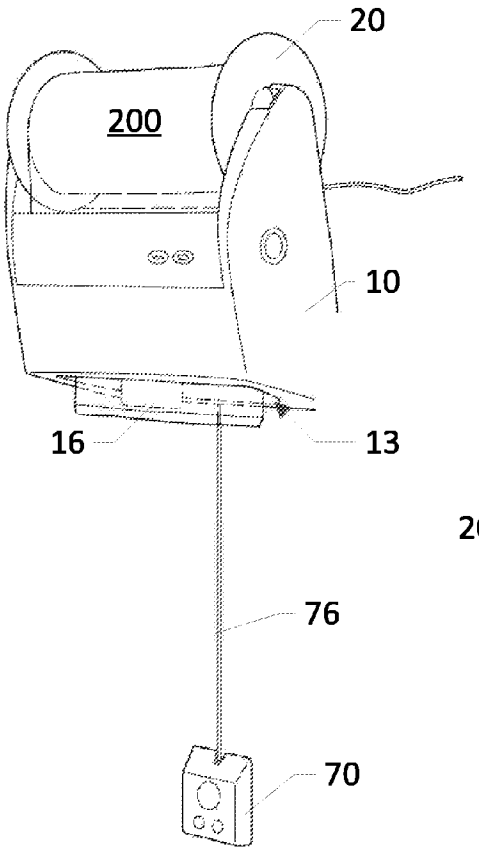

Having thus described the invention in general terms, reference will now be made to the accompanying drawings, which are not necessarily drawn to scale, and wherein:

FIG. 1 shows a perspective view of an automated inflation device according to one embodiment of the present invention;

FIG. 2A shows a top plan view of a portion of an inflatable film web according to one embodiment of the present invention;

FIG. 2B shows a cut-away perspective view of a portion of an inflatable film web according to one embodiment of the present invention;

FIG. 3 shows an interior left-side perspective view of an inflation device according to one embodiment of the present invention;

FIG. 4 shows an interior right-side perspective view of an inflation device according to one embodiment of the present invention;

FIG. 5 shows an interior front view of an inflation device according to one embodiment of the present invention;

FIG. 6 shows an interior front view of an inflation device with a film web loaded therein according to one embodiment of the present invention;

FIG. 7 is a bottom view of an inflation device with a film web loaded therein according to one embodiment of the present invention; and FIGS. 8A-8C show perspective views of an inflation device inflating an inflatable film web according to one embodiment of the present invention.

DETAILED DESCRIPTION OF VARIOUS EMBODIMENTS

Various embodiments of the present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Various embodiments of the present invention generally relate to an automated inflation device configured for inflating an inflatable structure, which can then be used—for example—as a protective packaging material. As described in detail herein, various embodiments of the inflation device are configured to be mounted on a wall for convenient installation and use. According to certain embodiments, the inflation device is configured to automatically inflate multiple inflatable chambers in the inflatable structure using an efficient inflation-at-a-distance method. As explained below, this method does not require heat sealing of the inflatable structure or insertion of an inflation device into the inflatable structure, which results in more efficient inflation of the inflatable structure both in terms of cost and operational efficiency. Moreover, various embodiments are provided with one or more user input controls and/or remote sensors to enable a user to conveniently request inflation of a particular number of inflatable chambers or a particular length of the inflatable structure.

Automated Inflation Device & Inflatable Structure

FIG. 1 shows an automated inflation device 100 according to one embodiment of the present invention. In the illustrated embodiment, the automated inflation device 100 comprises an inflation housing 10, an inflatable structure holder 20, a remote sensor 70, and an external power supply 80. As shown in FIGS. 3-7, the inflation housing 10 houses an engagement device 30, a pressurized air source 50, and a control unit 60. As described in detail herein, the inflatable structure holder 20 is configured to hold an inflatable structure in the form of a continuous web 200 of flexible film defining a series of inflatable chambers (shown in FIGS. 2, 6, and 8A-8C). The engagement device 30 is generally configured to advance the film web 200 from the inflatable structure holder 20 in a machine direction for inflation by the pressurized air source 50. According to various embodiments, this is accomplished in an automated fashion dictated by the control unit 60, which is configured to control the action of the engagement device 30 and pressurized air source 50 in order to automatically advance the film web 200 and inflate a certain number of inflatable chambers or a certain length of the film web 200. In particular, the control unit 60 is configured to function based on user input received via various user controls 121, 122, 123 and/or feedback from the remote sensor 70.

As shown in FIG. 1, the inflation device's housing 10 is configured to be mounted on a vertical wall 3 (e.g., by one or more fasteners or other attachment devices). For example, as shown in FIGS. 3-5, one embodiment of the housing 10 defines a rear aperture 12 through which a screw or other fastener may be inserted into the wall 3. Referring back to FIG. 1, the inflatable structure holder 20 comprises a detachable spool around which the film web 200 can be rolled and which is configured to engage upwardly extending arms 11 of the housing 10. In this way, the inflatable structure holder 20 is configured to support the rolled film web 200 above the housing 10. As explained in detail herein, the inflatable structure holder 20 permits the film web 200 to be unrolled as it is drawn downwardly by the engagement device 30 for inflation within an inflation cavity of the housing 10 and dispensing out of the inflation cavity's exit opening 13 defined on the underside of the housing 10.

FIG. 2A shows a portion of the continuous film web 200 defining an inflatable chamber 205. As shown in FIG. 2, the inflatable chamber 205 is in fluid communication with a one-way valve 204, through which fluid may enter the inflatable chamber 205. In the illustrated embodiment, the one-way valve 204 includes an external valve opening 208, an internal valve opening 207, and a fluid channel 206 configured to connect the external valve opening 208 and internal valve opening 207 such that air (or other fluids) may flow therebetween. For example, as shown in the cut-away view of FIG. 2B, pressurized air (or other fluids) may be directed into the external valve opening 208, flow through the fluid channel 206, through the internal valve opening 207, and into the inflatable chamber 205. In particular, the external valve opening 208 is configured such that pressurized air may be directed through the one-way valve 204 at a distance (i.e., such that such insertion does not occur between the pressurized fluid source outlet and the external valve opening during inflation).

After inflation, the pressurized air directed into the inflatable chamber 205 is held therein by the one-way valve 204, which self-seals when the chamber 205 is inflated. As will be appreciated from the description herein, this one-way valve 204 eliminates the need for heat sealing of the film web 200 during inflation and the use of the inflation-at-a-distance method eliminates the need for insertion of an inflation nozzle or other device into a portion of the film web 200.

As explained in detail below, a user can separate an inflated portion of the film web 200 by tearing the web along perforations 209 provided adjacent each inflatable chamber 205. To deflate the chamber 205, a straw or other elongate member can be inserted through the one-way valve 204 in order to relieve the pressure-induced seal and allow air to escape back out of the chamber 205 through the valve 204. As will be appreciated from the description herein, the film web 200 may define a plurality of inflatable chambers 205 having one or more one-way valves 204 arranged in series as described herein.

Referring back to FIG. 2A, the film web 200 also includes a first position marker 201 and a second position marker 202 printed on the film. As explained in detail below, the markers 201, 202 are configured to be detected by sensors 115, 116 monitored by the control unit 60 to facilitate alignment of the external valve opening 208 with the pressurized air source's outlet 55 during inflation. Detailed examples of various inflatable film structures that may be adapted for use with the inflation device 100, as well as method of their manufacture, are shown and described in U.S. application Ser. No. 13/109,410, now published as U.S. Patent Publication No. 2011/0247725, the entirety of which is hereby incorporated by reference. U.S. application Ser. No. 13/109,410 also provides additional information on various inflation-at-a-distance methods of inflating inflatable structures.

FIG. 3 provides a perspective view of the inflation device 100 with a portion of the housing 10 removed. As shown in FIG. 3, the housing includes a pair of upwardly extending arms 11 defining concave sections configured for receiving the inflatable structure holder 20. In this way, arms 11 can rotatably suspend the inflatable structure holder 20 above the housing 10 and the inflatable structure holder 20 can thereby support the rolled film web 200 above the engagement device 30. In addition, the housing 10 defines a cross member 14 extending across the front face of the housing 10 and including a control panel 61, which is configured to communicate with the control unit 60.

In the illustrated embodiment, the engagement device 30 includes a conveyor belt 31 driven by a motor 15, a nip roller 112, timing belt 110, inflation tongue 16, and various gears 101, 102, 103, 105, 106, 107. As shown in FIG. 3, the conveyor belt 31 comprises a short belt (e.g., a rubber belt) configured to grip and advance the film web 200 as it is driven by the motor 15. In one embodiment, the motor 15 comprises an electric DC motor powered by the external power supply 80. However, according to various embodiments, the motor 15 may comprise any suitable drive mechanism powered by any suitable power source.

As shown in FIG. 3, the motor 15 is configured to directly drive a motor gear 101. The motor gear 101 is intermeshed with an intermediate gear 102, which is in turn intermeshed with a first belt gear 103 connected to a drive roller 105 (shown in dashed lines as it is concealed behind the belt 31). In various embodiments, the drive roller 105 is an elongate, cylindrical member configured to rotate and drive the conveyor belt 31 such that the belt 31 rotates along with the drive roller 105. Accordingly, when the motor 15 is activated, the rotation of the motor gear 101 is imparted to the conveyor belt 31 via the intermediate gear 102, the first belt gear 103, and the drive roller 105.

As described in greater detail below, the housing 10 also includes an inflation tongue 16 positioned within the housing's inflation cavity. As explained in greater detail below, the inflation tongue 16 helps maintain the position of the film web 200 in relation to the pressurized air source 50 to facilitate efficient inflation of the film web 200. Further, the housing 10 also includes a first pair of inflation level sensors 118 and second pair of inflation level sensors 119 configured to detect the degree to which an inflatable structure has been inflated during inflation within the housing 10.

FIG. 4 provides a perspective view of an opposite side of the inflation device 100 with the housing 10 removed to reveal additional components of the engagement device 30. As shown in FIG. 4, the end of the drive roller 105 opposite the first belt gear 103 is connected to a second belt gear 106, which also rotates with the drive roller 105. The second belt gear 106 intermeshes with a timing belt gear 107, which has a larger diameter than the second belt gear 106 and—as a result—is driven by the second belt gear 106 at a lower rotational speed. FIG. 4 also shows the location of the control unit 60 within the housing 10. According to various embodiments, the control unit 60 may comprise a programmable logic controller (PLC) or any other device capable of controlling the action of the engagement device 30 and pressurized air source 50.

FIG. 5 provides a front view of the inflation device 100 with the housing 10 removed and the conveyor belt 31 disengaged and pulled forward to reveal a timing belt 110, nip roller 112, and the pressurized air source 50. In the illustrated embodiment, the timing belt 110 is positioned proximate an inner side edge of the housing 10 and adjacent the edge of the conveyor belt 31 nearest to the second belt gear 106. In particular, the timing belt 110 is configured to engage a side of the film web 200 opposite the side engaged by the conveyor belt 31 (e.g., such that a side edge of the film web 200 is pinched between the belts 31, 110). As shown in FIG. 5, the timing belt 110 is driven by the timing belt gear 107. Accordingly, as the conveyor belt 31 is driven by the motor 15, the second belt gear 106 drives the timing belt gear 107, which causes the timing belt 110 to rotate at a slower speed that the conveyor belt 31. As discussed in greater detail below, the rotational speed differential between the belts 31, 110 causes the external valve opening 208 of the film web to be slightly pinched open, thereby improving air flow into the one-way valve 204 from the pressurized air source 50.

As shown in FIG. 5, the pressurized air source 50 is positioned within the housing 10 and comprises a fan 51, a nozzle 53, and an outlet 55. According to various embodiments, the fan 51 is configured generate pressurized air flow through the nozzle 53 and out of the outlet 55. As described in greater detail below, the control unit 60 is configured to control the operation of the fan 51 in order to control air flow exiting the outlet 55. As will be appreciated from FIG. 5, the outlet 55 is positioned proximate the timing belt 110 and configured to direct pressurized air toward the external valve 208 of the film web 200.

In the illustrated embodiment of FIG. 5, the nip roller 112 comprises an elongate roller (e.g., a cylindrical member with a rubber coating) configured to press the film web 200 against the conveyor belt 31. In particular, as shown in FIG. 5, the roller 112 is positioned near the upper end of the housing 10 and extends across the length of the conveyor belt 31 such that the width of the film web 200 may be pinched between the belt 31 and roller 112 as is drawn off of the inflatable structure holder 20. In one embodiment, the nip roller 112 is spring loaded such that it is biased toward the conveyor belt 31.

FIG. 5 also shows the inflation tongue 16 in greater detail. According to various embodiments, the inflation tongue 16 comprises a plate that is hinged to the housing's cross member 14 such that it hangs downwardly from the cross member 14 and can pivot relative to the cross member 14. During inflation, the inflation tongue 16 rests on the film web 200 to maintain the web 200 in proper alignment with the pressurized air source's outlet 55 during inflation. In various other embodiments, the inflation tongue may be biased (e.g., by a spring) to apply additional pressure to the film web 200 during inflation.

Additionally, FIG. 5 reveals a first position sensor 115 and a second position sensor 116 provided on the control panel 61 just above the nip roller 112 within the housing 10. During inflation of the film web 200, the first position sensor 115 is configured to detect the presence of the first position marker 201 on the film web 200, while the second position sensor 116 is configured to detect the presence of the second position marker 202 on the film web 200. According to various embodiments, the first and second position sensors 115, 116 may comprise optical color sensors or any other detection devices capable of sensing the presence of the position markers 201, 202 on the film web 200. As explained in greater detail below, feedback provided by the position sensors 115, 116 helps ensure proper alignment of the film web's external valve opening 208 with the pressurized air source's outlet 55.

Operation & Use of Automated Inflation Device

FIGS. 6-8 illustrate various aspects of the operation and use of the inflation device 100 according to various embodiments. FIG. 6 provides a front view of the inflation device 100 with the housing 10 removed and the conveyor belt 31 disengaged and pulled forward to show how the film web 200 is initially loaded into the inflation device 100. As shown in FIG. 6, the film web 200 is first rolled onto the inflatable structure holder 20 (e.g., either by being rolled directly onto the inflatable structure holder 20 or by inserting elongate portion of the inflatable structure holder 20 through the core of a previously rolled web of film 200). The inflatable structure holder 20 is then engaged with concave portions of the upwardly extending arms 11 of the housing 10. Next, the film web 200 is drawn downwardly into the housing 10 and threaded beneath the cross member 14 and between the nip roller 112 and conveyor belt 31.

As noted above, the spring loaded nip roller 112 presses the film web 200 against the conveyor belt 31 such that the film web 200 is drawn off of the inflatable structure holder 20 as the conveyor belt 31 rotates. In this way, the engagement device 30 can advance the film web 200 in a machine direction by rotating the conveyor belt 31. In addition, the edge of the film web 200 proximate its one-way valve 204 is sandwiched between the conveyor belt 31 and the timing belt 110, which is configured to rotate at a slightly slower speed than the conveyor belt 31 in order to pinch the film web's external valve opening 208 open.

Once the film web 200 has been properly loaded, the control unit 60 causes the film web 200 to be advanced to an inflation position. In certain embodiments, this is accomplished at least in part based on feedback from one or more of the position sensors 115, 116. For example, in one embodiment, the second position sensor 116 and second position marker 202 are configured such that, when the second position sensor 116 detects the presence of the second position marker 202, the film web 200 is positioned with its external valve opening 208 substantially aligned with the outlet 55 of the pressurized air source. When the external valve openings 208 is aligned with the outlet 55, the film web 200 is in an inflation position and is ready for inflation of the inflatable chamber 205 in communication with the aligned external valve opening 208.

FIG. 7 provides a bottom view of the inflation device 100 looking toward the housing's inflation cavity and with the film web 200 advanced to the inflation position. As can be seen from FIG. 7, the outlet 55 is configured such that pressurized air generated by the fan 51 is directed out of the outlet 55 toward the external valve opening 208 and at an angle to the plane of the film web 200. The surface of the film web 200 guides the pressurized air into the external valve opening 208, where it is then guided through the fluid channel 206 and into the inflatable chamber 205. In addition, the inflation tongue 16 rests against the film web 200 to maintain the alignment of the external valve opening 208 and outlet 55.

With the film web 200 held in the inflation position by the belts 31, 110 and nip roller 112, inflation of one of the inflatable chambers 205 may begin. According to various embodiments, the control unit 60 is configured to monitor and control the degree to which an inflatable chamber 205 is filled with air. Referring back to the illustrated embodiment of FIG. 1, the control unit 60 is configured to communicate with a first inflation level button 121 and a second inflation level button 122. In response to the user pressing the first inflation level button 121, the control unit 60 causes the pressurized air source 50 to inflate the chamber 205 such that it is half-filled with air.

For example, with the first inflation level button 121 selected, the control unit 60 confirms the film web 200 is in the inflation position (e.g., via the position sensors 115, 116) and activates the pressurized air source's fan 51. The fan 51 delivers high-pressure air flow which travels through the nozzle 53, exits from the outlet 55, and enters through the film web's external valve opening 208 (which is pinched open by the conveyor belt 31 and timing belt 110). As the film web's chamber 205 inflates, it expands into the housing 10 in a direction toward the inflation level sensors 118, 119. The fan 51 continues to deliver air flow until the first inflation level sensor 118 detects the presence of the chamber 205. In particular, the first inflation level sensor 118 is positioned such that, when the chamber 205 expands into the sensor's line of sight, it will be approximately half full with air. Upon receiving a signal from the first inflation level sensor 118, the control unit 60 shuts off the fan 51 and advances the film web 200 in the machine direction. The pressure of the air trapped within the chamber 205 causes the one-way valve 204 to self-seal in order to maintain the chamber half-filled with air. Once the film web 200 is advanced such that the next chamber 205 is in the inflation position, the process begins again.

By contrast, with the second inflation level button 122 selected, the control unit 60 allows the fan 51 to continue delivering high-pressure air flow into the chamber 205 until the second inflation level sensor 119 detects the presence of the expanding chamber 205. In particular, the second inflation level sensor 119 is positioned such that, when the chamber 205 expands into the sensor's line of sight, it will be substantially full with air. Upon receiving a signal from the second inflation level sensor 119, the control unit 60 shuts off the fan 51. Again, the pressure of the air trapped within the chamber 205 causes the one-way valve 204 to self-seal in order to maintain the chamber completely filled with air. Additionally, it should be noted that the inflation tongue 16 continues to rest on the film web 200 during inflation to maintain alignment of the external valve opening 208 and the outlet 55.

If multiple chambers 205 are to be inflated, the control unit 60 advances the film web 200 such that the next chamber 205 is in the inflation position, the process begins again. Once the necessary chambers 205 have been inflated, the engagement device 30 advances the film web 200 slightly in the machine direction to a tear-off position, where the inflated portion of the film web 200 can be easily separated via the perforation 209 by a user. In certain embodiments, this is accomplished at least in part based on feedback from one or more of the position sensors 115, 116. For example, in one embodiment, the first position sensor 115 and first position marker 201 are configured such that, when the first position sensor 115 detects the presence of the first position marker 201, the film web 200 is in the tear-off position.

In order to dictate the number of times the inflation process is repeated—and therefore the number of chambers 205 along the length of the film web 200 that are inflated—the inflation device 100 includes a number of additional control modes. In particular, referring back to FIG. 1, the housing 10 includes an inflation mode button 123 configured to communicate with the control unit 60 in order to select one of a plurality of inflation modes.

For example, in one embodiment, the control unit 60 is programmed such that—in response to a user pressing and releasing the inflation mode button 123 once—the control unit 60 causes one inflatable chamber 205 to be inflated (in accordance with the user's selection of the half or full inflation via the inflation level buttons 121, 122) and advances the next uninflated chamber 205 to the inflation position. Likewise, in response to the user pressing and releasing the inflation mode button 123 multiple times (e.g., two, three, etc. times), the control unit 60 causes the corresponding number of inflatable chambers 205 to be inflated. For example, if a user presses and releases the inflation mode button 123 three times, the control unit 60 causes the pressurized air source 50 and engagement device 30 to inflate three successive chambers 205 in the film web 200 (again in accordance with the user's selection of the half or full inflation via the inflation level buttons 121, 122) and advances a fourth uninflated chamber 205 to the inflation position.

Additionally, if a user presses and holds the inflation mode button 123, the pressurized air source 50 and engagement device 30 will continuously inflate successive chambers 205 in the film web 200 until the user again presses the inflation mode button 123 to cease inflation (or, alternatively, continues inflation until the user releases the inflation mode button 123). In certain embodiments, the control unit 60 may be configured with a maximum inflation limit (e.g., 100 chambers), whereby the user must again press the inflation mode button 123 to inflate additional chambers 205 in the film 200.

Additionally, the control unit 60 may be configured to dictate inflation of the film web 200 based on feedback from the remote sensor 70. As shown in the FIG. 1, the remote sensor 70 is configured to be removably secured to a vertical wall 3 beneath the inflation device's housing 10. Accordingly, in various embodiments, the remote sensor 70 may comprise a sensor housing having one or more attachment features provided on its rear wall. For example, in certain embodiments the remote sensor 70 may include attachment features such as a tacky rubberized surface, suction cups, a micro-suction material, a hook-and-loop material, clip, or any feature suitable for securing the sensor housing to a vertical surface. As will be appreciated from the description herein, the remote sensor 70 may also be configured to be secured to other objects or surfaces, including dispensing bins or machine components.

In the illustrated embodiment, the remote sensor 70 is an ultrasonic sensor having an ultrasonic emitter 72 and an ultrasonic receiver 73 configured to detect the presence of the inflated film web 200 in front of the sensor housing. In particular, the remote sensor 70 is configured to transmit signals to the control unit 60 in order to provide feedback indicative of whether an inflated portion of the film web 200 has been dispensed to a length that hangs in front of the position sensor 70 (wherever it may be positioned). For example, in the illustrated embodiment of FIG. 1, the remote sensor 70 is tethered to the housing 10 by a communication cable 76 configured to communicate with the control unit 60 (e.g., a USB cable, ethernet cable, a coaxial cable, a twisted pair of copper wires, or any other acceptable communication medium). In certain embodiments, the communication cable 76 may be retractable. In other embodiments, the remote sensor 70 may be configured to communicate with the control unit 60 wirelessly (e.g., via Bluetooth or another remote communication protocol). In such embodiments, the remote sensor 70 may be tethered (e.g., with a non-communicative retractable cable) or non-tethered. Additionally, as will be appreciated from the description herein, the remote sensor 70 may comprise any suitable sensing device capable of detecting the presence of the film web 200 (e.g., optical sensor, IR sensor, etc.).

In operation, a user may select a "length" inflation mode by pressing an activation button 75 on the remote sensor 70, which indicates this mode to the control unit 60. With the length inflation mode selected, the control unit 60 causes the pressurized air source 50 and the engagement device 30 to continuously inflate successive inflatable chambers 205 along the film web 200 (again in accordance with the user's selection of the half or full inflation via the inflation level buttons 121, 122) until the remote sensor 70 indicates that the inflated film web's length has reached the remote sensor 70.

As an example, this is shown in FIGS. 8A-8C. FIG. 8A shows the film web 200 in the inflation position and ready for inflation. As shown in FIG. 8B, after the user presses the activation button 75 on the remote sensor 70, a first chamber 205 of the film web is inflated and advanced out of the exit opening 13 of the housing 10. This process continues with multiple chambers 205 being inflated until the remote sensor 70 detects the presence of the film web 200, as shown in FIG. 8C.

As will be appreciated from these figures, the user can easily control the length of inflated film web 200 needed by simply positioning the remote sensor 70 at different locations along the wall 3. Similarly, by positioning the remote sensor 70 in a bin or other receptacle, a user may also control the amount of inflated chambers 205 generated by the inflation device 100. For example, in certain embodiments the remote sensor 70 may be positioned such that it is not directly adjacent the portion of a bin where the inflated film web 200 enters and will only detect the presence of the film web when the bin fills to the height level where the remote sensor 70 is positioned.

In addition, with the length inflation mode activated, once a user tears off a portion of the inflated film web 200, the inflation process will restart and continue until the detected length is again reached. In this way, the inflation device 100 can automatically replenish a consistent length of inflated film web 200. This would also work in the aforementioned bin context, where—if the level of inflated film 200 drops below the position of the remote sensor 70—the inflation device 100 restarts inflation to begin refilling the bin.

Various Additional Embodiments of Inflation Device

As will be appreciated from the description herein, various modifications to the inflation device 100 described herein are contemplated as being within the scope of the invention. For example, in regard to the housing 10, the inflatable structure holder 20 may comprise a separate member removable from the housing 10, or may comprise an integrated portion of the housing 10 configured to receive the film web 200 (e.g., a horizontally oriented cylindrical arm having an open end for receiving the film web 200, or a pivotable arm connected to the housing 10 and configured to receive the rolled film web 200). In addition, various embodiments of the housing 10 may be positioned in other fashions. For example, in certain embodiments, the housing 10 may include a base member configured to rest on a horizontal surface (e.g., a table).

In addition, the engagement device 30 may comprise any number of mechanical components configured to advance and position the film web 200 as described herein. For example, in certain embodiments, multiple nip rollers, conveyor belts, or timing belts may be used. In addition, certain embodiments may be configured to function without a timing belt 110 (e.g., where the film can be inflated without pinching open the valve opening).

Further, the pressurized air source 50 may comprise any suitable source of pressurized fluid according to various embodiments. Indeed, the inflation device 100 may be configured to inflate the chambers 205 of the film web 200 with various gases, liquids, or other suitable fluids based on user needs and applications. Additionally, in certain embodiments, the fluid source may be configured to fill the chambers 205 by inserting a nozzle into a valve opening (i.e., without using the inflation-at-a-distance method described above). In addition, the pressurized air source 50 may make use of any suitable pressurized air source, including a compressor or canisters of pressurized air (or other gases).

In addition, the inflation device 100 may be configured to continuously advance the film web 200 as the chambers 205 are inflated (e.g., without stopping the film web 200). In such embodiments, the pressurized air source may continuously generate pressurized air or may be programmed to intermittently generate pressurized air. In regard to the control unit 60 and the method of inflation, according to various embodiments, the control unit 60 may be programmed to execute any number of routines to facilitate inflation of the film web 200 in accordance with user preferences. Moreover, the inflation device 100 may be configured to operate with any suitable inflatable structures, including—but not limited to—rolled film webs. For example, in certain embodiments the inflatable structure may be provided in the form of folded sheets contained in a basket or other receptacle.

CONCLUSION

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An inflation device for inflating an inflatable structure defining a plurality of inflatable chambers, the inflatable chambers being capable of holding therein a quantity of a fluid and having an external opening for receiving the fluid during inflation, the inflation device comprising:

a housing comprising a holder configured for holding the inflatable structure;

an engagement device for engaging the inflatable structure and advancing the inflatable structure from the holder in a machine direction;

a pressurized fluid source defining a fluid outlet, the pressurized fluid source configured for inflating at least one proximate inflatable chamber in the inflatable structure by directing pressurized fluid from the fluid outlet through the external opening of the at least one proximate inflatable chamber;

a remote sensor tethered to the housing, wherein the remote sensor is configured to be positioned beneath the engagement device and for sensing the presence of the inflatable structure in proximity to the remote sensor; and a control unit in communication with the remote sensor, the control unit being configured to cause the engagement device and pressurized fluid source to advance the inflatable structure in the machine direction and inflate multiple inflatable chambers of the inflatable structure until the remote sensor detects the presence of the inflatable structure in proximity to the remote sensor.

2. The inflation device of claim 1, wherein the housing is configured for being mounted on a substantially vertical surface.

3. The inflation device of claim 1, wherein the engagement device and pressurized fluid source are configured to inflate the at least one proximate inflatable chamber with fluid within the housing and subsequently advance the inflated chamber in the machine direction out of the housing.

4. The inflation device of claim 1, wherein the tether comprises a retractable tether configured to enable the remote sensor to be positioned at an adjustable distance beneath the housing and to thereby control the length of the inflated structure that is inflated by the inflation device.

5. The inflation device of claim 1, wherein the housing and holder are configured such that the holder holds the inflatable structure above the housing.

6. The inflation device of claim 1, wherein the remote sensor comprises an ultrasonic sensor.

7. The inflation device of claim 1, wherein the control unit is configured to cause the engagement device and pressurized fluid source to resume inflating inflatable chambers of the inflatable structure and advance the inflatable structure in the machine direction when the remote sensor indicates the inflatable structure is no longer present in proximity to the remote sensor.

8. The inflation device of claim 1, wherein the holder is configured for holding an inflatable structure in the form of a continuous web of film defining a series of inflatable chambers; and wherein the engagement device is configured to advance the continuous web of film such that the inflatable chambers are aligned in the machine direction.

9. The inflation device of claim 1, wherein the holder is configured for holding the continuous web of film in rolled form.

10. The inflation device of claim 9, wherein the holder comprises a spool.

11. The inflation device of claim 1, wherein the pressurized fluid source comprises a pressurized air source configured to inflate the inflatable chambers with pressurized air.

12. The inflation device of claim 1, wherein the external opening comprises an external valve opening, and wherein the engagement device is configured to advance the inflatable structure such that the pressurized fluid source is not inserted into the external valve opening during inflation.

13. The inflation device of claim 1, further comprising one or more user input devices configured to receive user input requesting deactivation of the remote sensor and specifying a desired amount of inflatable chambers to be inflated; and wherein the control unit is configured to, in response to the user input, cause the engagement device and pressurized fluid source to advance the inflatable structure in the machine direction and automatically inflate the requested amount of inflatable chambers of the inflatable structure.

14. The inflation device of claim 1, further comprising a tongue member configured to engage the inflatable structure during inflation to maintain alignment of the fluid outlet and external opening of the at least one proximate inflatable chamber.

15. The inflation device of claim 1, wherein the engagement device comprises at least one conveyor belt configured to engage the inflatable structure and advance the inflatable structure in the machine direction by rotating.

16. The inflation device of claim 1, wherein the engagement device includes one or more position sensors configured to detect the position of the inflatable structure in relation to the pressurized fluid source's outlet and maintain the inflatable structure in a position during inflation where the external opening of the inflatable structure is substantially aligned with the fluid outlet of the pressurized air source.

* * * * *